US011014091B2

(12) United States Patent
Voesten et al.

(10) Patent No.: US 11,014,091 B2
(45) Date of Patent: May 25, 2021

(54) METHOD TO OPERATE A GRINDER

(71) Applicant: GEA Food Solutions Bakel B.V., EN Bakel (NL)

(72) Inventors: Martien Voesten, Ottersum (NL); Louis Marcelis, Castenray (NL)

(73) Assignee: GEA FOOD SOLUTIONS BAKEL B.V., Bakel (NL)

( * ) Notice: Subject to any disclaimer, the term of this patent is extended or adjusted under 35 U.S.C. 154(b) by 375 days.

(21) Appl. No.: 15/739,307

(22) PCT Filed: Jul. 11, 2016

(86) PCT No.: PCT/EP2016/066420

§ 371 (c)(1),
(2) Date: Dec. 22, 2017

(87) PCT Pub. No.: WO2017/009282

PCT Pub. Date: Jan. 19, 2017

(65) Prior Publication Data

US 2018/0185852 A1 Jul. 5, 2018

(30) Foreign Application Priority Data

Jul. 16, 2015 (EP) ..... 15176995

(51) Int. Cl.
*B02C 18/38* (2006.01)
*B02C 18/22* (2006.01)
(Continued)

(52) U.S. Cl.
CPC ..... *B02C 18/38* (2013.01); *B02C 18/2258* (2013.01); *B02C 25/00* (2013.01); *B02C 2018/164* (2013.01)

(58) Field of Classification Search
CPC ... B02C 18/2258; B02C 18/30; B02C 18/365; A22C 5/00; A22C 7/0092; A22C 17/0026
(Continued)

(56) References Cited

U.S. PATENT DOCUMENTS 3,310,086 A * 3/1967 Lasar ..... B02C 18/302 241/82.1
3,984,056 A * 10/1976 Hartley ..... B02C 18/302 241/82.1
(Continued)

FOREIGN PATENT DOCUMENTS

CN 201179470 Y * 1/2009 ..... B02C 18/30
CN 201179470 Y 1/2009
(Continued)

OTHER PUBLICATIONS

International Search Report and Written Opinion for International Application No. PCT/EP2016/066420, dated Sep. 27, 2016.
(Continued)

*Primary Examiner* — Shelley M Self
*Assistant Examiner* — Jared O Brown
(74) *Attorney, Agent, or Firm* — The Dobrusin Law Firm, P.C.

(57) ABSTRACT

The present invention relates to a method to grind meat in grinder wherein the meat is provided to the grinder via a hopper (5) and transported by a feeder worm (2) to a rotating processing worm (3) which conveys the meat towards a cutting set (4) which grinds the meat and wherein the feeder worm (2) initially rotates in a first direction. In case the feeder worm (2) is overloaded, its direction of rotation is reversed to a second direction for a certain period of time and then reversed back to the first direction.

20 Claims, 1 Drawing Sheet

(51) Int. Cl.
*B02C 25/00* (2006.01)
*B02C 18/16* (2006.01)

(58) Field of Classification Search
USPC ..... 241/82.1; 426/231, 518, 646
See application file for complete search history.

(56) References Cited

U.S. PATENT DOCUMENTS

| | | | | |
|---|---|---|---|---|
| 5,230,475 | A | 7/1993 | Gerner | |
| 6,405,662 | B1 | 6/2002 | Williams et al. | |
| 7,383,842 | B1 * | 6/2008 | Sabol | B30B 9/12 134/65 |

FOREIGN PATENT DOCUMENTS

| | | | | |
|---|---|---|---|---|
| DE | 728318 | C | 11/1942 | |
| DE | 2812536 | A1 | 9/1979 | |
| DE | 9104544 | U1 | 6/1991 | |
| DE | 202006001147 | U1 | 6/2006 | |
| EP | 0573759 | B1 | 7/1997 | |
| GB | 2268097 | A | 1/1994 | |
| JP | 2000093925 | A * | 4/2000 | B30B 9/12 |

OTHER PUBLICATIONS

International Preliminary Report on Patentability for International Application No. PCT/EP2016/066420, dated Jun. 27, 2017.
Notice of opposition against the European Patent No. 16738407.2; dated Mar. 12, 2020.

* cited by examiner

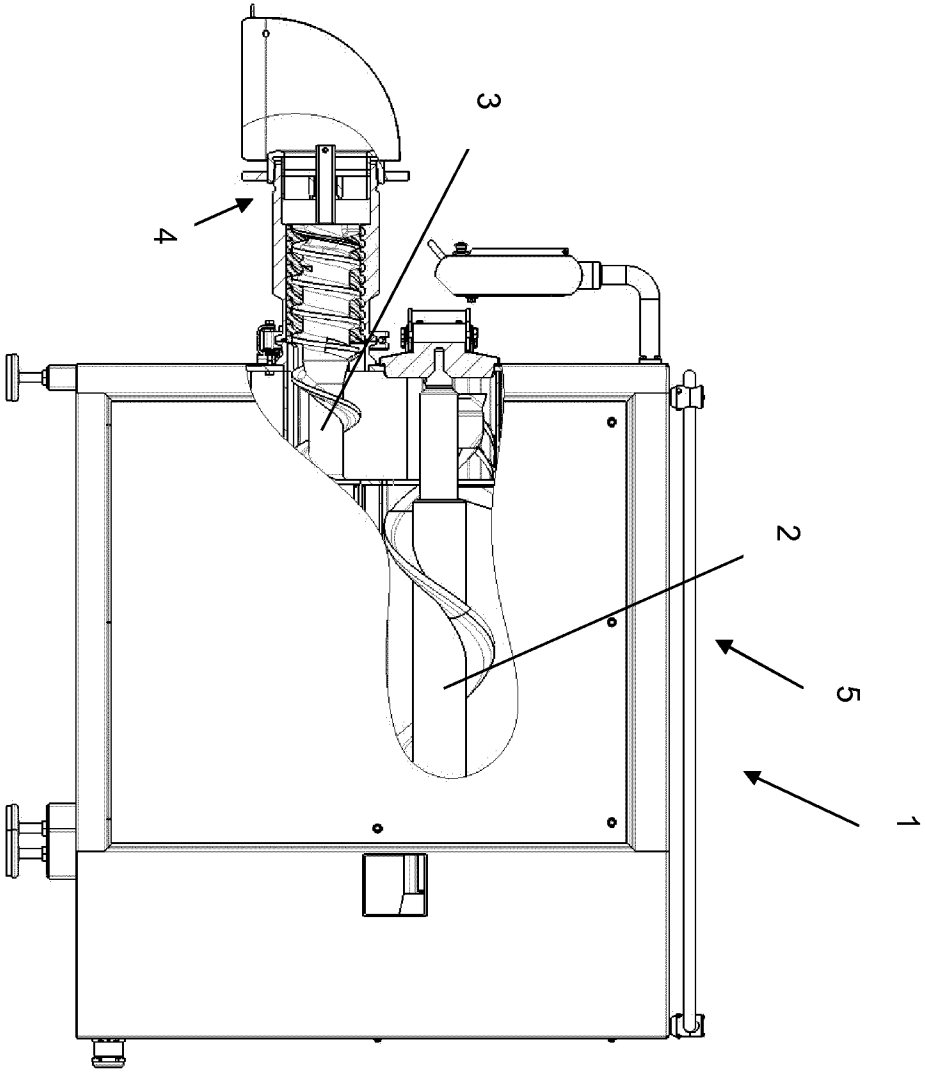
1
5
2
3
4

METHOD TO OPERATE A GRINDER

The present invention relates to a method to grind meat in a grinder wherein the meat is provided to the grinder via a hopper and transported by a feeder worm to a rotating processing worm which conveys the meat towards a cutting set which grinds the meat and wherein the feeder worm initially rotates in a first direction.

Such grinders are known from the state of the art and are, for example, utilized to produce minced meat. Nowadays, in many cases, frozen food is ground, which in the past resulted in many shut downs, which reduces the profitability of a meat grinding plant.

It was therefore the objective of the present invention to provide a method which does not comprise the deficiencies of the state of the art.

This is attained by a method to grind meat in a grinder, wherein the meat is provided to the grinder via a hopper and transported by a feeder worm, to a rotating processing worm, which conveys the meat towards a cutting set which grinds the meat, wherein the feeder worm initially rotates in a first direction, characterized in that in case the feeder worm is overloaded, its direction of rotation is reversed to a second direction for a certain period of time and then reversed back to the first direction.

The present invention relates to a method to grind meat in a grinder. This grinder comprises a hopper which carries the meat to be grinded. At the base of the hopper a feeder worm is provided which rotates in a first direction around its middle axis. Additionally, a rotating processing worm is part of the grinder which conveys the meat towards a cutting sets, which cuts the meat in pieces so that the resulting product is minced meat. The cutting set comprises at least a perforated disk and a rotating knife which is in most cases driven by the processing worm. According to the present invention, in case an overload, the rotation of the feeder worm is reversed to a second opposite direction for a certain period of time and then reverse back to the first direction. Due to this change in direction of rotation, occurring blockages of the feeder worm can be loosened and no shut down of grinder is needed.

Preferably, during production under normal conditions, the feeder worm and the processing worm rotate in the same direction, each around their middle axis, respectively.

In case the direction of rotation of the feeder worm is reversed to a second direction of rotation, this rotation in the second direction only takes place preferably 0.5-3 revolutions and is then turned back to the initial first direction.

Preferably, the overload of the feeder worm is detected by the power-consumption of the motor that drives the feeder worm. In case this power-consumption exceeds a certain value, the direction of rotation is automatically reversed for a certain period of time and then reversed back to its initial direction of rotation.

According to another preferred embodiment of the present invention, the overload situation is detected by a sensor that detects the speed of rotation of the feeder worm. Typically, the grinder is set to maintain a certain speed of rotation of the feeder worm. In case, this speed of rotation cannot be maintained by the motor due to a blockage situation, the direction of rotation is automatically reversed for some revolutions and then turned back to its original direction of rotation. Alternatively or additionally, the torque needed to rotate the feeder worm is measured and in case this torque exceeds a certain value, the direction of rotation is automatically reversed for some revolutions and then turned back to its original direction of rotation.

According to another preferred embodiment of the present invention, the processing worm maintains its direction of rotation during the entire process, i.e. also during the rotation of the feeder worm in the second direction.

Preferably, before and after a change of direction of rotation of the feeder worm the speed of rotation of the feeder worm is at least essentially identical.

Preferably, the direction of rotation of the feeder worm is reversed manually or automatically.

Preferably, the grinder is automatically shut down when two overload situations occur in 3 to 8 minutes.

The invention is now explained according to the only FIG. 1.

FIG. 1 shows a grinder on which the inventive method can be executed. This grinder comprises a hopper 5, which accommodates the meat to be ground, e.g. blocks of frozen meat. At the bottom of the hopper 5 a feeder worm 2 is provided, which is driven by a motor and rotates during processing in a first direction around its longitudinal axis. Additionally, here below the feeder worm 2, a processing worm 3 is provided, which conveys the meat towards a cutting set 4, but which also comprises means to compress the meat. The cutting set comprises at least a perforated plate and a knife, which is driven by the processing worm and rotates relative to the perforated plate. Due to the cooperation of the perforated plate and the knife, minced meat is produced. During normal process conditions, the feeder worm and the processing worm rotate in the same direction of rotation.

In case of an overload situation, e.g. in case the power-consumption of the motor which drives the feeder worm in exceeds a certain level, the rotation of the feeder worm is stopped and reversed for a certain amount of revolutions, preferably 0.5-3 revolutions. Then the feeder worm is stopped again and reversed back to its initial direction of rotation. During this change of direction of rotation of the feeder worm the processing worm maintains its direction of rotation as well as its speed of rotation. After the reversed rotation of the feeder worm, the feeder worm rotates in the same direction and at the same speed as prior to the overload situation.

This reverse of direction of rotation can be initiated manually or automatically, by means of a sensor, which senses for example the power uptake and/or the speed of rotation of the feeders worm and/or torque needed to rotate the feeder worm. In case, an overload situations occurs twice in a certain period of time, which can be set by the operator, the grinder is automatically shut down in order to avoid damage of the grinder.

REFERENCE SIGNS

1 Grinder
2 feeder worm
3 processing worm
4 cutting set
5 hopper

The invention claimed is:

1. A method to grind meat in a grinder, comprising:

providing the meat to the grinder via a hopper;

transporting the meat by a feeder worm that rotates in a first direction to a rotating processing worm, the processing worm conveys the meat towards a cutting set;

grinding the meat with the cutting set;

wherein the feeder worm initially rotates in the first direction, and if the feeder worm is overloaded, the feeder worm is reversed and rotates in a second direction for a certain period of time, the feeder worm is then reversed back and rotates in the first direction; and wherein the processing worm maintains its rotation in the first direction while the feeder worm rotates in the second direction.

2. The method according to claim 1, wherein initially the feeder worm and the processing worm rotate in the same direction.

3. The method according to claim 1, wherein the feeder worm rotates between 0.5 and 3 revolutions in the second direction.

4. The method according to claim 1, wherein the method comprises detecting the overload of the feeder worm by a power-consumption of the feeder worm.

5. The method according to claim 1, wherein the method comprises detecting the overload of the feeder worm by a speed of rotation of the feeder worm.

6. The method according to claim 1, wherein the method comprises maintaining a speed of the processing worm during rotation of the feeder worm in the second direction.

7. The method according to claim 1, wherein the method comprises reversing back a rotation speed of the feeder worm to a same speed of rotation as an initial speed of rotation of the feeder worm.

8. The method according to claim 1, wherein the method comprises manually or automatically reversing the first direction of rotation of the feeder worm and/or the second direction of rotation of the feeder worm.

9. The method according to claim 1, wherein the method comprises automatically shutting down the grinder when two overload situations occur within 3-8 minutes.

10. The method according to claim 1, wherein the method comprises detecting the overload of the feeder worm by measuring torque required to rotate the feeder worm.

11. The method according to claim 1, wherein an axis of rotation of the feeder worm is generally parallel to an axis of rotation of the processing worm.

12. A method to grind meat in a grinder, comprising:

providing the meat to a grinder via a hopper;

transporting the meat by a feeder worm to a rotating processing worm, the processing worm conveys the meat towards a cutting set;

grinding the meat with the cutting set;

detecting an overload of the feeder worm; and rotating the feeder worm in a first rotational direction, and if the overload of the feeder worm is detected, reversing the first rotational direction of the feeder worm to a second rotational direction for a certain period of time and then reversing the feeder worm back to the first rotational direction;

maintaining a rotational speed of the processing worm during rotation of the feeder worm in the second rotational direction;

maintaining a rotational direction of the processing worm while the feeder worm rotates in the second rotational direction;

reversing back a rotational speed of the feeder worm to a same speed of rotation as an initial rotational speed of rotation of the feeder worm; and wherein initially, the feeder worm and the processing worm rotate in a common direction.

13. The method according to claim 12, wherein the method comprises manually or automatically reversing the first rotational direction of the feeder worm and/or the second rotational direction of the feeder worm.

14. The method according to claim 13, wherein an axis of rotation of the feeder worm is generally parallel to an axis of rotation of the processing worm.

15. The method according to claim 14, wherein the method comprises automatically shutting down the grinder when two overload situations occur within 3-8 minutes.

16. The method according to claim 15, wherein the feeder worm rotates between 0.5 and 3 revolutions in the second direction.

17. The method according to claim 16, wherein the overload of the feeder worm is detected by a power-consumption of the feeder worm.

18. The method according to claim 16, wherein the overload of the feeder worm is detected by a speed of rotation of the feeder worm.

19. The method according to claim 16, wherein the overload of the feeder worm is detected by measuring torque required to rotate the feeder worm.

20. A method to grind meat in a grinder; comprising:

providing the meat to a grinder via a hopper;

transporting the meat by a feeder worm to a rotating processing worm; the processing worm conveys the meat towards a cutting set;

grinding the meat with the cutting set;

rotating the feeder worm in a first rotational direction, if an overload of the feeder worm is detected, reversing the first rotational direction of the feeder worm to a second rotational direction for a certain period of time and then reversing the feeder worm back to the first rotational direction;

automatically shutting down the grinder after the overload occurs twice within 3-8 minutes;

maintaining a rotational speed of the processing worm during the second rotational direction of the feeder worm;

maintaining a rotational direction of the processing worm while the feeder worm rotates in the second rotational direction;

wherein initially, the feeder worm and the processing worm rotate in a common direction;

wherein the feeder worm rotates between 0.5 and 3 revolutions in the second rotational direction;

reversing back a rotational speed of the feeder worm to a same speed of rotation as an initial rotational speed of rotation of the feeder worm, manually or automatically reversing the first and/or second rotational direction of the feeder worm, wherein an axis of rotation of the feeder worm is generally parallel to an axis of rotation of the processing worm, wherein the overload of the feeder worm is detected with a sensor that detects a speed of rotation of the feeder worm, and if the speed of the rotation of the feeder worm is not maintained at a preset speed, the rotational direction of the feeder worm is automatically reversed.

* * * * *